United States Patent [19]

Strong

[11] Patent Number: 4,741,387

[45] Date of Patent: May 3, 1988

[54] LOCKING MEANS FOR MITER GAUGE ATTACHMENT

[76] Inventor: Donald Strong, 20425 Beatrice St., Livonia, Mich. 48152

[21] Appl. No.: 80,801

[22] Filed: Aug. 3, 1987

[51] Int. Cl.[4] ..... B27B 25/10; B27B 27/08

[52] U.S. Cl. ..... 83/421; 83/437; 83/435.1; 83/425; 83/477.2

[58] Field of Search ..... 83/421, 425, 437, 477.2, 83/581, 435.1; 269/196, 229

[56] References Cited

U.S. PATENT DOCUMENTS

| | | | |
|---|---|---|---|
| 2,237,556 | 4/1941 | Hedgpeth | 83/437 X |
| 2,884,965 | 5/1959 | Stahl | 83/437 X |
| 3,083,744 | 4/1963 | Vold | 83/437 X |
| 4,259,887 | 4/1981 | Dean | 83/437 |
| 4,454,793 | 6/1984 | Strong | 83/421 |
| 4,622,123 | 11/1986 | Nejame | 269/229 |

*Primary Examiner*—Donald R. Schran
*Attorney, Agent, or Firm*—Charles W. Chandler

[57] ABSTRACT

An attachment for a miter gauge of the type having an arm slideably moveable in the slot of a work table so that a wooden workpiece is moved into engagement with a table saw blade. The attachment includes a fence that is connected to the miter gauge body, and a stop member that is attached at a selected position along the length of the knee. The fence has a slot which receives the head of a threaded fastener. The other end of the fastener is connected to a cam mounted within the stop member in such a manner that the user can lock the stop member at a selected position along the fence by turning a knob attached to the cam.

3 Claims, 2 Drawing Sheets

LOCKING MEANS FOR MITER GAUGE ATTACHMENT

BACKGROUND OF THE INVENTION

This invention is related to an attachment for a miter gauge body used for cutting a wooden workpiece on a table saw, and more particularly to an improved means for locking the stop member to the fence by turning a knob so as to cam a threaded fastener that connects the fence to the stop member.

In my U.S. Pat. No. 4,454,793 issued June 19, 1984 for "Attachment For A Miter Gauge", I described an improved attachment for a miter gauge used for cutting tapered cuts in a wooden workpiece with a table saw. The attachment comprised an elongated fence mounted edgewise on the table and fastened by a pair of threaded fasteners to the miter gauge body. A stop member is mounted along the fence, extending at right angles to the fence so that the workpiece can be received in the right angle corner by the fence and the stop member. The stop member is connected to the fence by a fastener received in a longitudinal slot in the fence in a position accommodating the size and position of the workpiece.

In my aforementioned patent I employed a locking device having a locking member with a tapered opening. A tapered fastener having its end received in the tapered opening was adapted to cam the locking member to either lock or release the stop member by turning a knob. The locking member had a head received in the slot in the fence.

SUMMARY OF THE INVENTION

The preferred embodiment of the present invention provides an improved locking means for attaching the stop member to the fence. Further, the fence has been improved by forming it of an aluminum extrusion having a channel on opposite sides of the extrusion. A pair of fasteners are received in one of the channels to connect the fence to the miter gauge body. The other channel faces the stop member and receives the square head of an elongated fastener member. The threaded end of the fastener member is received in a plug mounted in an opening in a rotatably cam member. The cam member is rotatable about a first axis while the plug is rotatable with respect to the cam member about a parallel but spaced second axis.

A knob, mounted on the cam member, can be rotated by the user to cam the fastener either toward or away from the fence. When the fastener is biased away from the fence, it provides means for quickly locking the stop member to the fence.

The preferred embodiment provides a locking assembly that is inexpensive to manufacture, is reliable, is easier to adjust, to release or to lock the stop member to the fence.

Still further objects and advantages of the invention will become readily apparent to those skilled in the art to which the invention pertains upon reference to the following detailed description.

DESCRIPTION OF THE DRAWING

The description refers to the accompanying drawings in which like reference characters refer to like parts throughout the several views, and in which.

DESCRIPTION OF THE PREFERRED EMBODIMENT

Figure 1:
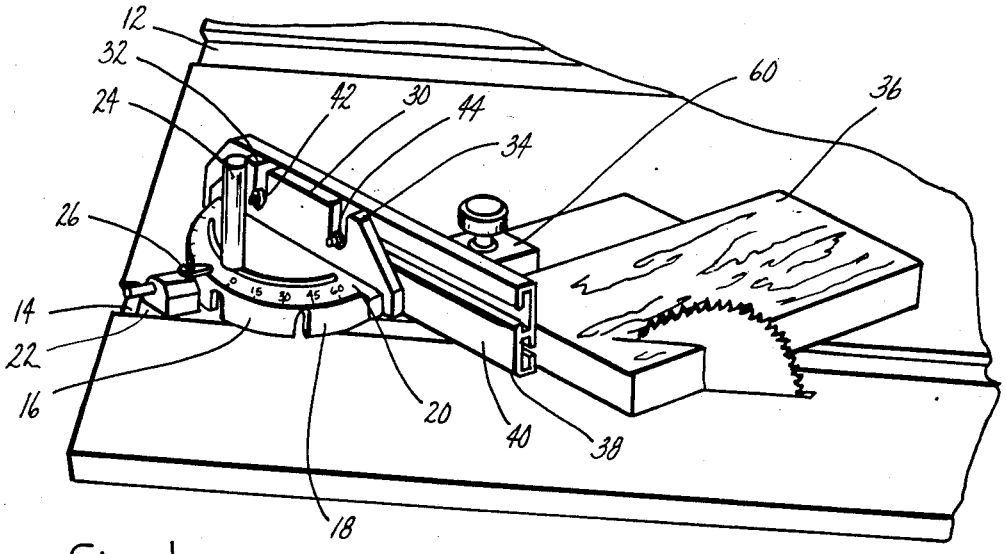
FIG. 1 is a perspective view illustrating a miter gauge having an attachment embodying the invention, for supporting a wooden workpiece adjacent a table saw blade.

Referring to the drawings, FIG. 1 illustrates a conventional table saw blade 10 mounted on work table 12 having a slot 14. Miter gauge 16 has a body 18 with a semicircular gauge and indicia 20 marked along the edge of the gauge to indicate various angular positions.

An elongated arm 22 is pivotally connected to body 18 and slideably mounted in slot 14. Handle 24 is threadably connected to arm 22 to lock it in a selected angle to body 16 according to pointer means 26.

The miter gauge body has an elongated support 30 having a pair of slots 32 and 34. When the miter gauge is being used in the conventional manner without the attachment, workpiece 36 is held in abutment with the support and then is pushed with the miter gauge along a path defined by slot 14 into cutting engagement with the table saw blade. The angle cut depends upon the angle of the workpiece with respect to slot 14. Thus, by adjusting body 18 with respect to the slot, the user can select the bias angle of the finished workpiece.

Attachment 38 is mounted on support 30. The attachment includes an aluminum extruded elongated fence 40. Fastener means 42 and 44 connect the fence to support 30. The bottom surface of the fence is co-planar with the bottom of the miter gauge body.

Figure 2:
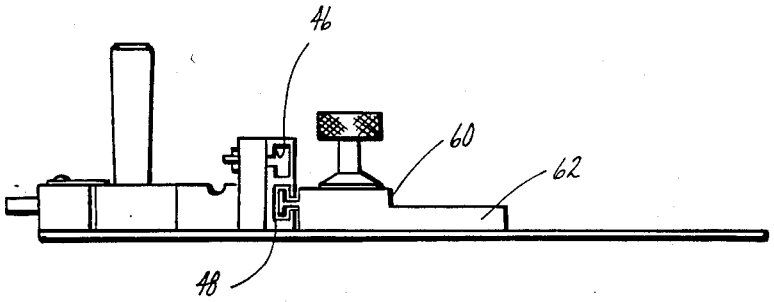
FIG. 2 is an elevational view of the miter gauge.
Figure 3:
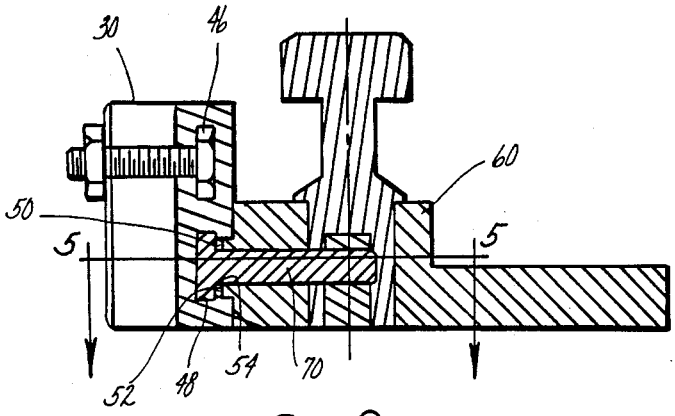
FIG. 3 is an enlarged sectional view of the stop member.

As best illustrated in FIGS. 2 and 3, the fence has two channel-shaped slots 46 and 48.

Fasteners 42 and 44 are received in slot 46, as illustrated in FIG. 3, to connect the fence to the support.

Slot 48 is similar to slot 46, and as best illustrated in FIG. 3, has a pair of shoulders 50 and 52 defining an opening 54.

Referring to FIGS. 1, 2, and 3, a stop unit 60 is connected to the fence. The stop unit has a work engaging surface 62 disposed at a 90° angle with respect to the work engaging surface of the fence. The bottom of the stop unit is also aligned with the bottom of the miter gauge body, both of which are disposed over arm 22.

Figure 4:
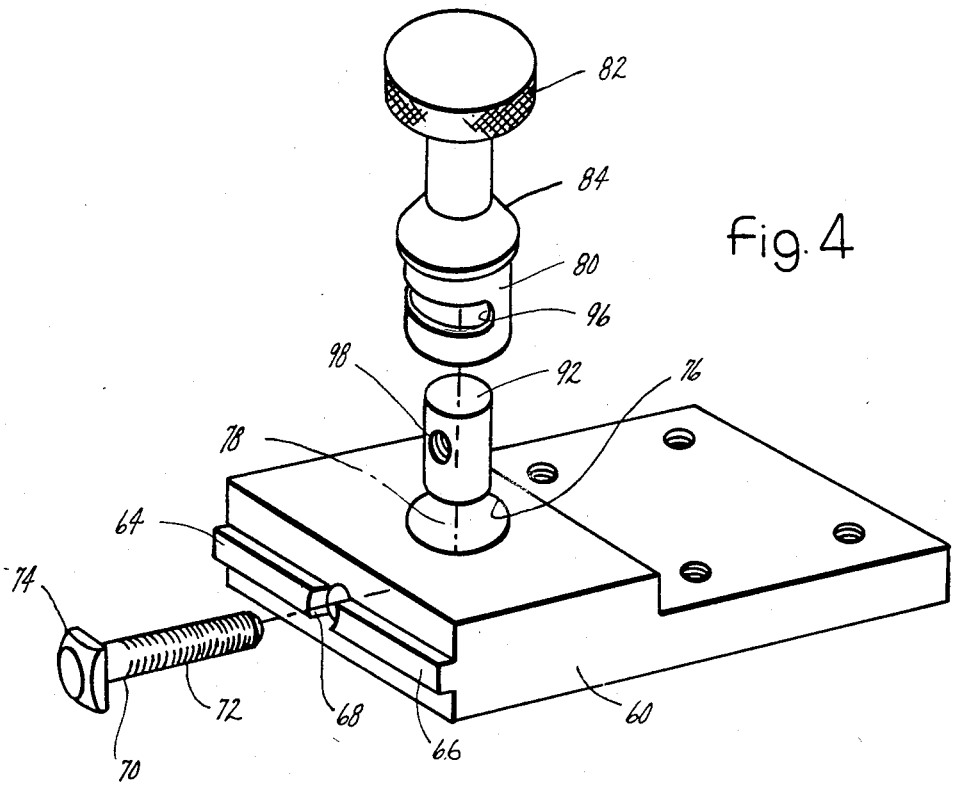
FIG. 4 is an exploded view of the locking means and stop member.

Referring to FIG. 4, the stop unit has a pair of aligned, elongated tongues 64 and 66 slideably received between the shoulders 50 and 52 of the fence opening. The stop unit body has a fastener-receiving opening 68 disposed between tongues 64 and 66. A threaded fastener 70, which functions as a locking member, has threaded end 72 received in opening 68, and a square head 74 at its other end. The square head is received in fence channel 48 and each side of the square head has a length corresponding to the width of the channel so that the fastener cannot be turned with respect to the fence when the head is disposed in the channel.

Figure 5:
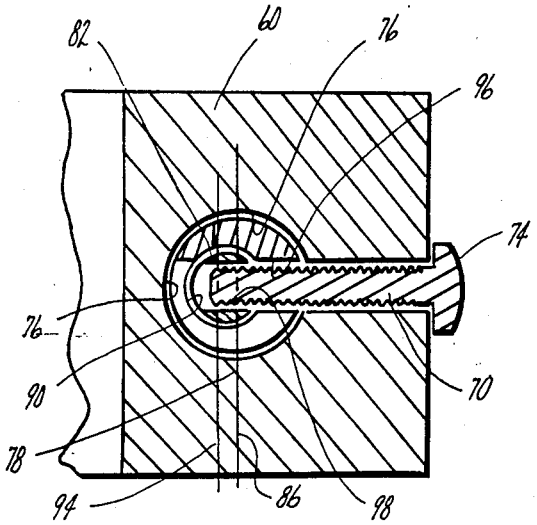
FIG. 5 is a view as seen along lines 5—5 of FIG. 3.
Figure 6:
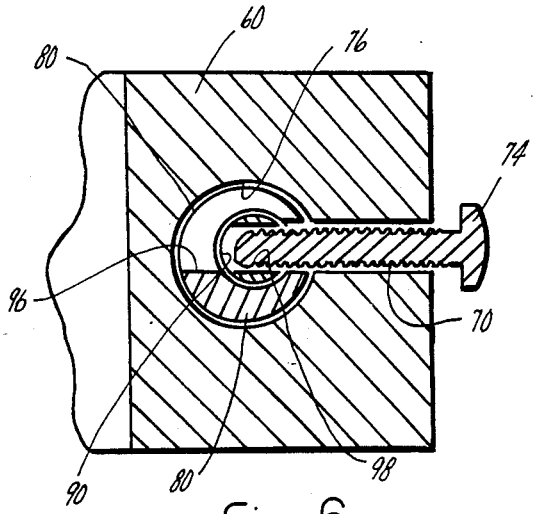
FIG. 6 is a view similar to FIG. 5 but showing the fastener in its release position.

Referring to FIGS. 4–6, the stop unit has a cylindrical opening 76 formed about an axis 78 that is disposed in a plane parallel to fence slot 48. A cylindrical cam member 80 is slideably mounted in opening 76. Adjusting knob 82 is attached to the upper end of cam member 80.

The cam member has an annular shoulder 84 which slideably engages the upper surface of stop unit 60. Thus the cam member is rotatable about axis 78.

Referring to FIG. 5, a phantom line 86 is illustrated as passing through the axis of rotation 78 of cam member 80. The cam member has a cylindrical opening 90 receiving plug 92. Plug 92 is rotatable about the axis of opening 90.

Phantom line 94 passes through the axis of rotation of plug 92 so that the plug is rotatable about an axis displaced the distance between parallel lines 86 and 94. Cam member 80 has an arcuate slot 96 for receiving fastener 70.

The plug has a threaded opening 98 for receiving the threaded end of fastener 70. The arrangement is such that as knob 82 is turned in one direction, the fastener head is moved toward the stop unit as illustrated in FIG. 5, and as the fastener knob is rotated in the opposite direction, the fastener head is moved away from the body. As the fastener member is moved toward the body, the head of the fastener member engages shoulders 50 and 52 of the fence slot, and continued rotation of the cam member causes the plug to become locked in position so that the fastener member forms a releasable connection between the stop unit and the fence.

The fastener member is a conventional bolt and provides means for quickly assembling or disassembling the locking means as well as for more easily adjusting the position of the stop unit along the fence.

Having described my invention, I claim:

1. An attachment for a miter gauge mounted on a table saw table, the gauge having a body, said attachment comprising:

an elongated fence having a slot having a pair of shoulders, and means for connecting the fence to the miter gauge body;

a stop member, and means for connecting the stop member to the fence comprising;

the stop member having a first opening formed about an axis disposed in a plane parallel to the slot in the fence;

a cam rotatably mounted in said first opening, and a knob connected to the cam for rotating the cam about said first axis, the cam having a slot formed about said first axis and communicating with said first opening;

a plug slideably mounted in said first opening so as to be rotatable therein about a second axis, the plug having a threaded opening;

structure on the stop member receivable in the slot in the fence such that the stop member is slidable along the fence, the stop member having a fastener-receiving opening extending from the first opening in the stop member;

a threaded member having a first end and a second end, and a head on the second end, the first end being received through the fastener-receiving opening in the stop member being threadably received in the threaded opening in the plug, and the head being received in the slot in the fence such that the head is in abutment with the slot shoulders such that rotation of the cam biases the plug and the fastener either toward or away from the fence slot depending upon the direction of rotation of the knob.

2. A combination as defined in claim 1, in which the head on the fastener member is square, and each side of the head has a length generally corresponding to the width of the slot in the fence so that the head cannot be rotated in the slot.

3. A combination as defined in claim 1, in which as the cam is rotated the fastener member moves from one end of the slot in the cam toward the other end, and the plug is moved a distance generally corresponding to the distance between said first and second axes.

* * * * *